US007176633B1

(12) United States Patent
Roberts

(10) Patent No.: US 7,176,633 B1
(45) Date of Patent: Feb. 13, 2007

(54) ARC LAMP WITH AN INTERNALLY MOUNTED FILTER

(75) Inventor: Roy D. Roberts, Hayward, CA (US)

(73) Assignee: Vaconics Lighting, Inc., Sunnyvale, CA (US)

( * ) Notice: Subject to any disclaimer, the term of this patent is extended or adjusted under 35 U.S.C. 154(b) by 319 days.

(21) Appl. No.: 10/732,787

(22) Filed: Dec. 9, 2003

(51) Int. Cl.
*H01J 17/16* (2006.01)

(52) U.S. Cl. ..... 313/634; 313/631; 313/574; 313/110

(58) Field of Classification Search ..... 313/631
See application file for complete search history.

(56) References Cited

U.S. PATENT DOCUMENTS 3,609,335 A * 9/1971 Kelly ..... 362/33
3,644,768 A * 2/1972 McRae ..... 313/113
4,054,812 A * 10/1977 Lessner et al. ..... 313/44
4,179,037 A * 12/1979 Chan et al. ..... 220/2.3 R
4,195,745 A 4/1980 Roberts et al.
4,396,857 A * 8/1983 Danko ..... 313/634
4,599,540 A 7/1986 Roberts
4,633,128 A 12/1986 Roberts et al.
4,658,179 A 4/1987 Roberts
4,702,716 A 10/1987 Roberts
4,724,352 A 2/1988 Schuda et al.
4,785,216 A 11/1988 Roberts et al.
4,823,043 A 4/1989 Roberts et al.
4,940,922 A 7/1990 Schuda et al.
5,299,279 A 3/1994 Roberts
5,399,931 A 3/1995 Roberts
5,418,420 A 5/1995 Roberts
5,561,338 A 10/1996 Roberts et al.
5,672,931 A 9/1997 Kiss et al.
5,721,465 A 2/1998 Roberts
6,034,467 A 3/2000 Roberts
6,114,807 A * 9/2000 Kavanagh ..... 313/570
6,181,053 B1 1/2001 Roberts
6,200,005 B1 3/2001 Roberts et al.
6,285,131 B1 9/2001 Kiss et al.
6,297,591 B1 10/2001 Roberts
6,316,867 B1 11/2001 Roberts et al.
6,351,058 B1 2/2002 Roberts
6,597,087 B2 7/2003 Roberts et al.
6,602,104 B1 8/2003 Roberts
6,670,758 B2 * 12/2003 Beech et al. ..... 313/634

* cited by examiner

*Primary Examiner*—Sikha Roy
(74) *Attorney, Agent, or Firm*—Blakely, Sokoloff, Taylor & Zafman LLP

(57) ABSTRACT

An arc lamp with a filter mounted internally has been disclosed. The arc lamp includes an anode, a cathode, a body defining a cavity, wherein the anode and the cathode are inside the cavity, and a filter mounted within the cavity. Other embodiments are claimed and described.

22 Claims, 6 Drawing Sheets

-- Prior Art --

ARC LAMP WITH AN INTERNALLY MOUNTED FILTER

FIELD OF INVENTION

The present invention relates to short arc lamps, and more particularly, to the filter of a short arc lamp.

BACKGROUND

In optical systems involving the generation and controlled radiation of long or continuous pulses of light, such as spectroscopy, or solar simulation, where high intensity, color correct illumination of sensitive working areas is required, such as in fiber optics illumination devices, it is advantageous to have a light source capable of producing the highest possible light flux density. Products utilized in such applications include short arc inert gas lamps. An existing short arc lamp includes a sealed chamber containing a gas pressurized to several atmospheres, and an opposed anode and cathode defining an arc gap. A window provides for the transmission of the generated light, and a reflector may be positioned surrounding the arc gap.

FIG. 1 shows an existing short arc lamp 100. The short arc lamp 100 includes a window 110, an external filter 120, a retainer ring support 125, a strut 130, a strut support ring 140, a cathode 160, an anode 170, and a ceramic body 180 having a curved surface 182, and a base 190. The window 110 is made of sapphire or quartz. The strut 130, supported by the strut support ring 140, braces the cathode 160. The anode 170 is mounted on the base 190 and is aligned with the cathode 160 along the axis 101. The ceramic body 180 has a parabolic surface 182 acting as a reflector. The ceramic body 180 is mounted on the base 190 at one end. The external filter 120 is mounted near the window 110 outside of the ceramic body 180 of the lamp 100 to reduce the intensity of light beam with certain wavelengths, such as ultra violet light, infra red light, etc. The retainer ring 125 holds the external filter 120.

One of the problems with the existing short arc lamp is the concentrated beam loading over a small clear aperture area on the filter 120. Such concentrated beam loading is likely to cause cracking and coating crazing of the filter 120, which may lead to spectral shifts and light transmission degradation. Moreover, the arc lamp 100 is typically installed within other equipment, such as a projector. Cracking of the filter 120 may damage the equipment within which the lamp 100 is installed. Besides causing property damages, cracking of the filter at high temperature may also cause injuries (e.g., burns, cut, etc.) on the user(s) of the lamp.

One of the existing solutions to the above problem is to place the external filter 120 as close as possible to the lamp window 110 in order to reduce beam loading concentration at the center of the external filter 120. Another existing solution is to put an ultra violet suppression coating on the lamp window 110 in order to reduce the heat and unwanted ozone and ultra-violet light caused by the ultra violet light from the lamp. Furthermore, some existing arc lamps include a hot mirror to reject infra red light, as well as narrow band filters and heat absorbing glass.

However, the above techniques do not solve the problem of beam loading concentration satisfactorily because the area of the light beam concentration on the external filter 120 remains about the same. Such concentration in a small area on the external filter 120 still makes the filter susceptible to cracking and coating crazing. Furthermore, the use of various coating on the lamp window 110 also increases the manufacturing cost of the lamp.

SUMMARY

An arc lamp with a filter mounted internally has been disclosed. The arc lamp includes an anode, a cathode, a body defining a cavity, wherein the anode and the cathode are inside the cavity, and a filter mounted within the cavity. Other features of the present invention will be apparent from the accompanying drawings and from the detailed description that follows.

BRIEF DESCRIPTION OF THE DRAWINGS

The present invention will be understood more fully from the detailed description that follows and from the accompanying drawings, which however, should not be taken to limit the appended claims to the specific embodiments shown, but are for explanation and understanding only.

DETAILED DESCRIPTION

In the following description, numerous specific details are set forth. However, it is understood that embodiments of the invention may be practiced without these specific details. In other instances, well-known components, structures, and techniques have not been shown in detail in order not to obscure the understanding of this description.

Figure 2:
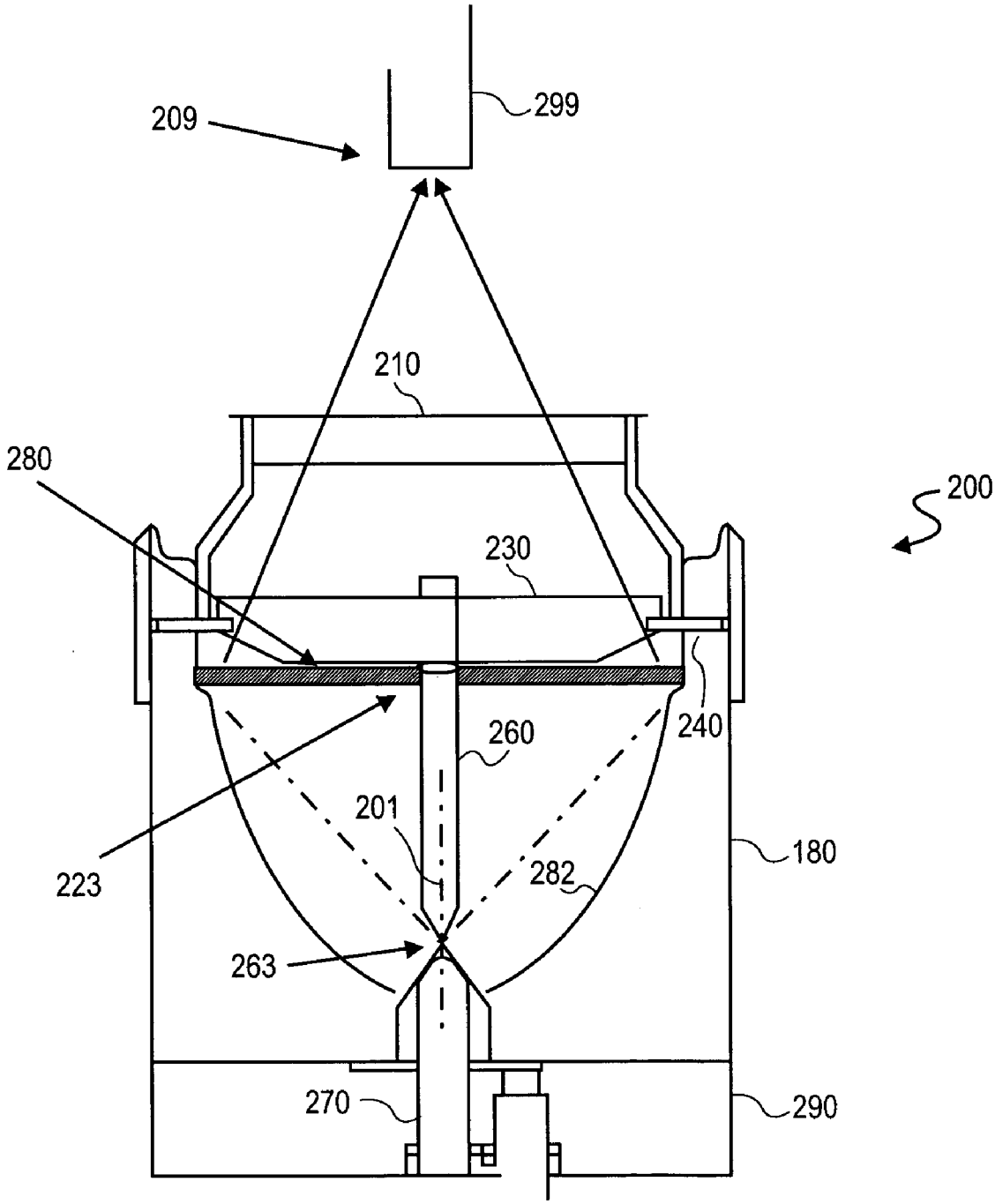
FIG. 2 shows one embodiment of an arc lamp.

FIG. 2 shows one embodiment of an arc lamp. The short arc lamp 200 includes a window 210, an internal filter 220, a washer 223, a strut 230, a strut support ring 240, a cathode 260, an anode 270, and a body 280 having a curved surface 282, and a base 290. The window 210 may be made of sapphire or quartz. The strut 230, supported by the strut support ring 240, braces the cathode 260. The anode 270 is mounted on the base 290 and is aligned with the cathode 260 along the axis 201 to define an arc gap 263 between the cathode 260 and the anode 270. The body 280 may be made of ceramic. The curved surface 282 of the body 280 may have a reflective coating acting as a light reflector. The curved surface 282 may be parabolic. The ceramic body 280 is mounted on the base 290 at one end. The internal filter 220 is mounted within the cavity defined by the ceramic body 280 of the lamp 200. In one embodiment, the filter 220 is mounted between the strut 230 and the arc gap 263. The filter 220 may be mounted closer to the strut 230 than the arc gap 263. The curved washer 223 preloads the filter 220 into the cavity of the body 280 and holds the filter 220 in place within the body 280. In one embodiment, an aperture is defined by the filter 220, through which the cathode 260 is mounted inside the lamp 200.

Figure 3:
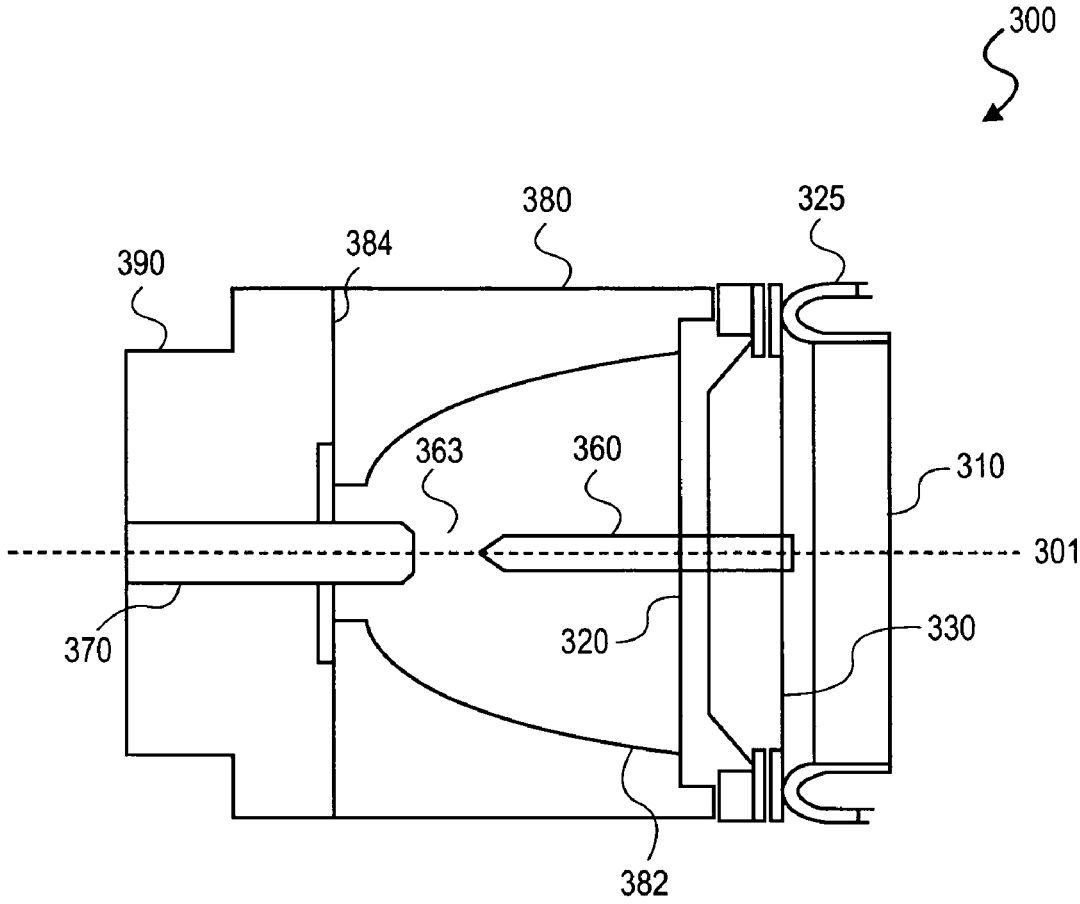
FIG. 3 shows one embodiment of an arc lamp.

FIG. 3 shows an alternate embodiment of an arc lamp. The lamp 300 includes a window 310, an internal filter 320, a window flange 325, a strut 330, a body 380, abase 390, a cathode 360, and an anode 370. The window 310 is mounted in the window flange 325, which is coupled to the body 380. In one embodiment, the body 380 is made of ceramic. The strut 330 braces the cathode 360 at one end and is coupled to the body 380 and the window flange 325 at another end. The body 380 has a reflector surface 382 to reflect light and a flat surface 384. The anode 370 is mounted in the base 390, aligned along the axis 301 with the cathode 360. The base 390 may be integrally attached to the flat surface 384 of the body 380 by brazing. The internal filter 320 is mounted within the cavity defined by the body 380. In one embodiment, the filter 320 is mounted between the strut 330 and the arc gap 363 between the anode 370 and the cathode 360. The filter 220 may be mounted closer to the strut 330 than the arc gap 363.

Figure 1:
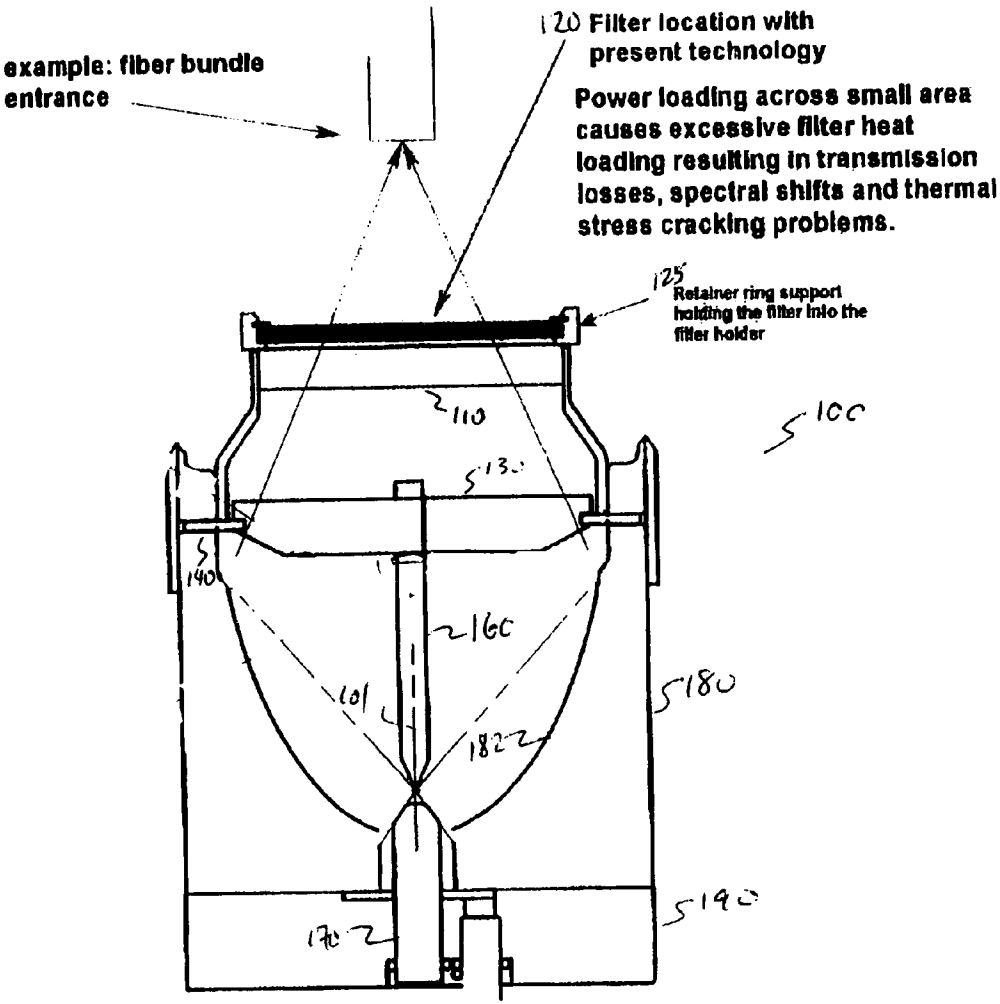
FIG. 1 shows an existing short arc lamp.

Referring to FIG. 2, with the filter 220 mounted within the cavity of the body 280, power loading by the light beam generated by the anode 270 and the cathode 260 is less concentrated because the light beam covers a larger surface area on the filter 220 than in the existing lamp 100 (referring to FIG. 1). With a larger surface area for power loading, transmission loss and spectral shifts are reduced in the lamp 200. Because of reduced power loading, the filter 220 is less likely to crack, especially around the aperture 223. In one embodiment, the internal filter 220 provides four to six times power loading reduction than the existing lamp 100 shown in FIG. 1.

In one embodiment, the arc lamp 200 is placed near a fiber bundle 299 such that the light beam from the lamp 200 enters the fiber bundle 299 through the entrance 209. Since the filter 220 is less likely to crack because of less concentrated power loading and the filter 220 is farther away from the fiber bundle 299, the fiber bundle is less likely to be damaged by cracking of the filter 220. Moreover, user injury can be avoided by reducing the likelihood of unwanted radiation due to cracking of the filter 220.

Figure 4A:
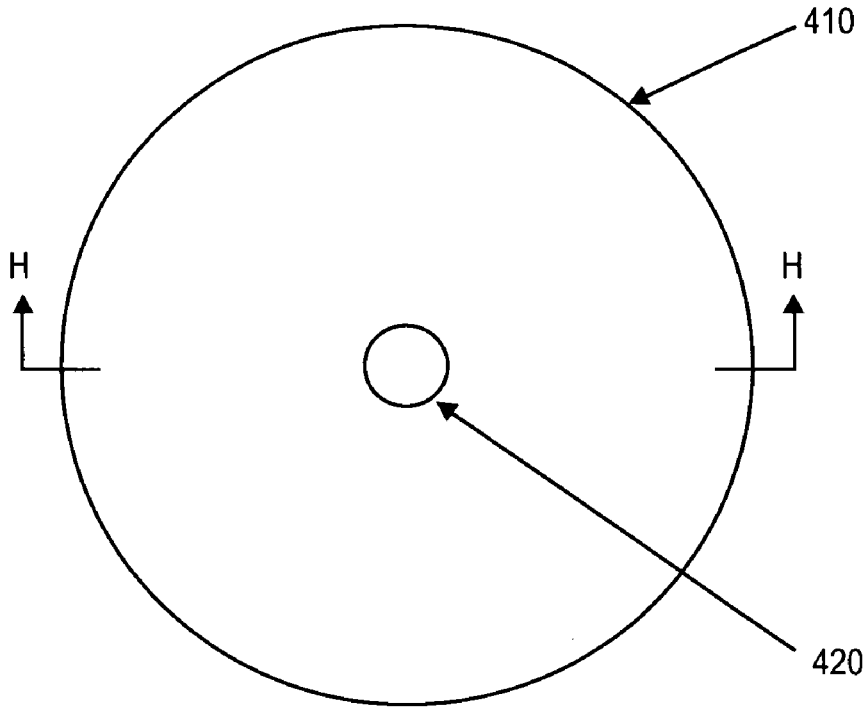
FIG. 4A shows one embodiment of an internal filter.
Figure 4B:
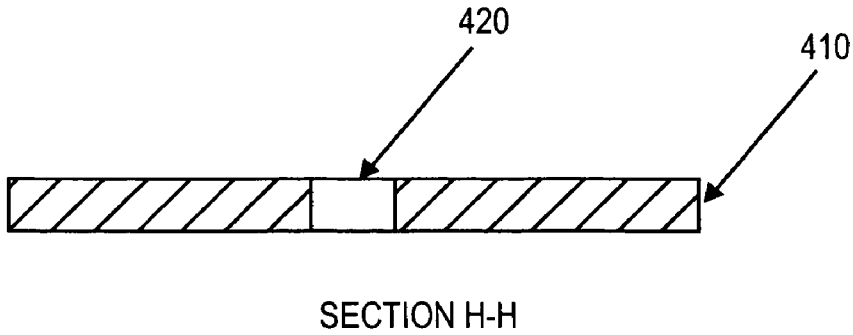
FIG. 4B illustrates a cross-sectional view of the internal filter shown in FIG. 4A.

FIG. 4A shows a top view of one embodiment of the internal filter. The internal filter 410 is in the shape of a circular disc. An opening or aperture 420 is defined at substantially the center of the filter 410. The aperture 420 may also be circular in shape. FIG. 4B shows a cross-sectional view of the filter 410. In one embodiment, the filter has a thickness of approximately 0.043 inches and a diameter of about 1.275 inches. The aperture may have an inside diameter of about 0.125 inches. In one embodiment, the filter 410 is made of quartz. The filter 410 may have an infrared rejection coating on one side and an ultra violet suppression coating on the other side. Alternatively, the filter 410 may be made of narrow bandpass glass or heat absorbing glass. The filter 410 may operate within the temperature range of −40° C. to 500° C.

Figure 5:
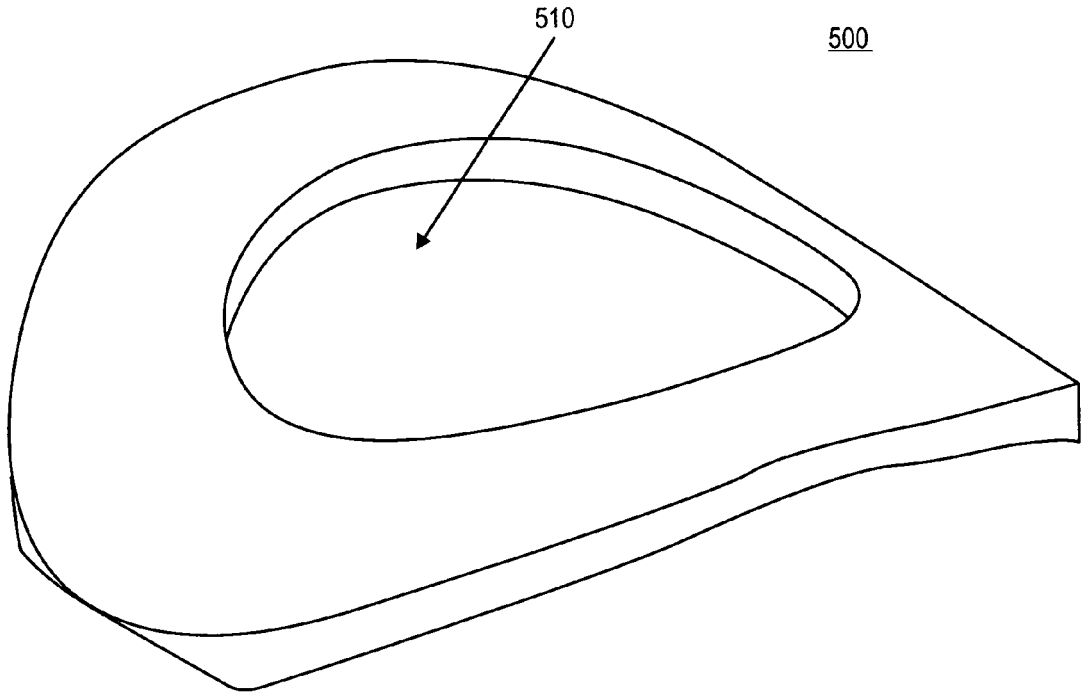
FIG. 5 shows one embodiment of a curved washer.

FIG. 5 shows one embodiment of a washer for mounting the internal filter inside the cavity of a lamp body. The washer 500 is curved with an opening 510 defined on the washer 500. When the filter 220 (referring to FIG. 2) is mounted inside the lamp 200, the washer 500 is placed between the filter 220 and the strut 230 such that the cathode 260 goes the opening 510. The washer 500 may be a spring washer.

Figure 6:
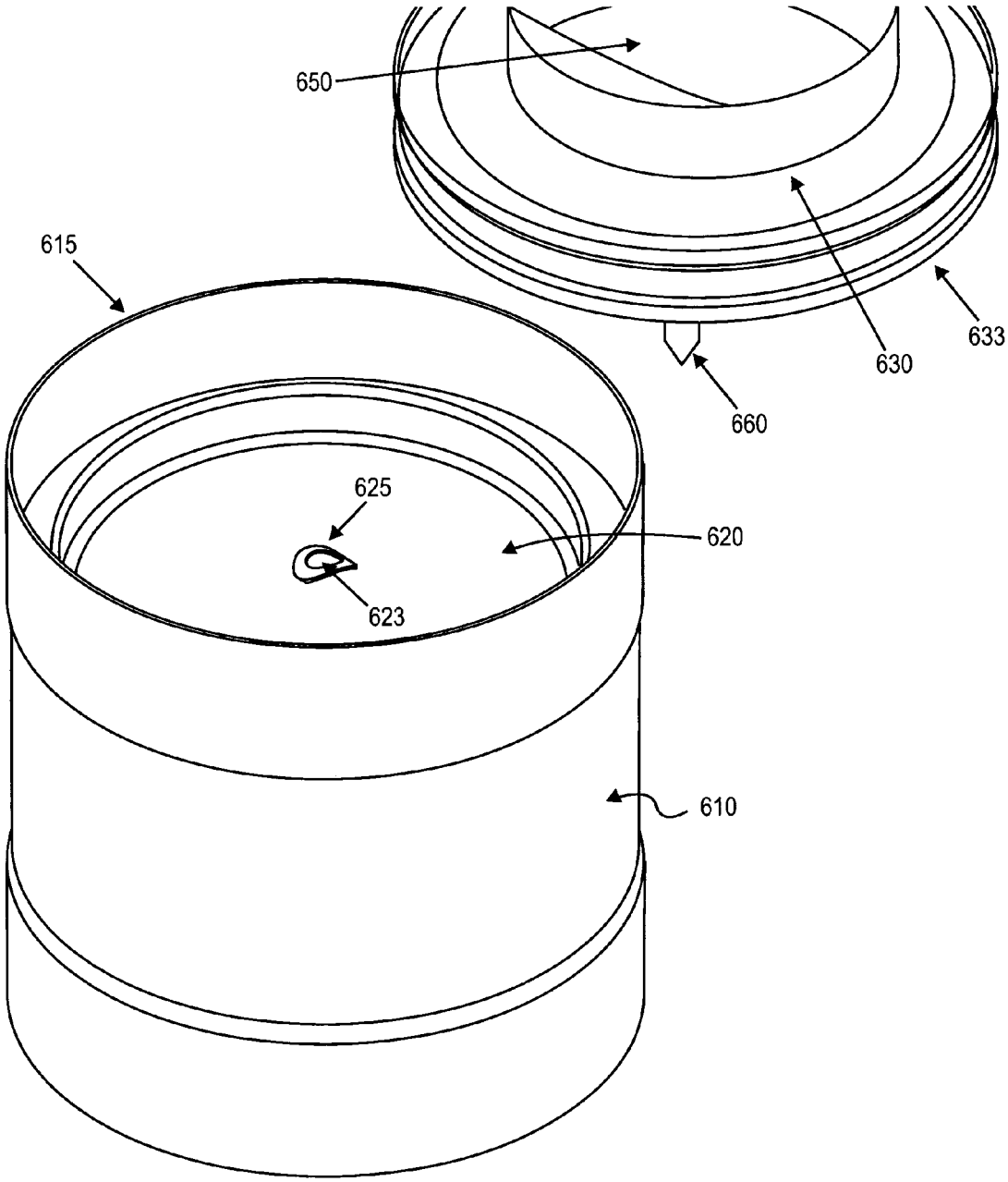
FIG. 6 shows one embodiment of an arc lamp.

FIG. 6 shows one embodiment of an arc lamp with the strut and the cathode separated from the lamp body and the filter for the purpose of illustration. The components of the lamp illustrated in FIG. 6 include a body 610, a filter 620, a washer 625, a strut 630, a strut-holding ring 633, a cathode 660, and a window 650. The filter 620 is mounted inside the body 610 near the top of the body 610. The filter 620 defines an opening, also referred to as an aperture 623, substantially centered on the filter 620. The washer 625 is placed over the aperture 623.

When the lamp 600 is assembled, the cathode held by the strut 630 is inserted into the cavity of the body 610 through the washer 625 and the aperture 623 of the filter 620. The strut 630 is mounted on or near the end 615 of the body 610 by the strut-holding ring 633.

The foregoing discussion merely describes some exemplary embodiments of the present invention. One skilled in the art will readily recognize from such discussion, the accompanying drawings and the claims that various modifications can be made without departing from the spirit and scope of the invention.

What is claimed is:

1. An arc lamp comprising:
an anode;
a cathode;
a body defining a cavity, wherein the anode and the cathode are inside the cavity;
a filter mounted within the cavity; and
a washer to hold the filter in place within the cavity.

2. An arc lamp comprising:
an anode;
a cathode;
a body defining a cavity, wherein the anode and the cathode are inside the cavity; and
a filter mounted within the cavity, wherein the filter includes an aperture through which the cathode goes.

3. The arc lamp of claim 2, wherein the filter is coated with a coating substantially over the aperture, the coating selected from a group consisting of an ultra violet suppression coating and an infrared rejection coating.

4. An arc lamp comprising:
an anode;
a cathode;
a body defining a cavity, wherein the anode and the cathode are inside the cavity;
a filter mounted within the cavity, wherein the filter is made of narrow bandpass glass; and
a washer to hold the filter in place within the cavity.

5. The arc lamp of claim 4, wherein the filter is made of heat absorbing glass.

6. The arc lamp of claim 4, wherein the filter comprises a circular quartz disc.

7. The arc lamp of claim 4, wherein the filter operates within a temperature range of −40° C. to 500° C.

8. An arc lamp comprising:
a body defining a cavity;
an anode;
a cathode substantially aligned with the anode to define an arc gap in between;
a strut holding the cathode; and
a filter mounted within the cavity between the strut and the arc gap.

9. The arc lamp of claim 8, wherein the filter includes an aperture through which the cathode goes.

10. The arc lamp of claim 8, wherein the filter is coated with a coating substantially over the aperture, the coating selected from a group consisting of an ultra violet suppression coating and an infrared rejection coating.

11. The arc lamp of claim 8, wherein the filter is made of narrow bandpass glass.

12. The arc lamp of claim 8, wherein the filter is made of heat absorbing glass.

13. The arc lamp of claim 8, wherein the filter comprises a circular quartz disc.

14. The arc lamp of claim 8, wherein the filter operates within a temperature range of −40° C. to 500° C.

15. A method to make an arc lamp, the method comprising:

mounting a filter within a cavity defined by a body of the arc lamp; and coupling a washer to the filter to hold the filter in place.

16. A method to make an arc lamp, the method comprising:

mounting a filter within a cavity defined by a body of the arc lamp; and coupling a washer to the filter to hold the filter in place, wherein the filter defines an aperture substantially centered on the filter.

17. The method of claim 16, further comprising mounting a cathode through the aperture of the filter.

18. The method of claim 16, further comprising putting a coating substantially over the aperture, the coating selected from a group consisting of an ultra violet suppression coating and an infrared rejection coating.

19. The method of claim 16, wherein the filter is made of narrow bandpass glass.

20. The method of claim 16, wherein the filter is made of heat absorbing glass.

21. The method of claim 16, wherein the lamp operates within a temperature range of −40° C. to 500° C.

22. The method of claim 16, wherein the filter comprises a circular quartz disc.

* * * * *